United States Patent [19]

Steffen

[11] 4,148,147

[45] Apr. 10, 1979

[54] METHOD FOR CONTROLLING THE CURING OF FIELD-HARVESTED GRAINS WITH MINIMUM ENERGY CONSUMPTION

[76] Inventor: Sylvester L. Steffen, R.R. 3, New Hampton, Iowa 50659

[21] Appl. No.: 846,402

[22] Filed: Oct. 28, 1977

[51] Int. Cl.[2] ..... F26B 3/06

[52] U.S. Cl. ..... 34/27; 34/32; 34/50; 34/76; 62/176 E

[58] Field of Search ..... 34/27, 32, 76, 50, 54, 34/46, 77, 233; 62/93, 176 E; 236/44 R

[56] References Cited

U.S. PATENT DOCUMENTS

| | | | |
|---|---|---|---|
| 1,119,011 | 12/1914 | Grosvenor | 62/238 |
| 2,716,289 | 8/1955 | Lauck | 34/77 |
| 2,799,947 | 7/1957 | Elwess | 34/77 |
| 3,595,028 | 7/1971 | Schrader | 62/176 E |
| 4,043,051 | 8/1977 | Lussenden | 34/77 |

*Primary Examiner*—John J. Camby
*Assistant Examiner*—Larry I. Schwartz
*Attorney, Agent, or Firm*—Henderson, Sturm, Cepican and Fix

[57] ABSTRACT

A process for optimum usage of energy in the CURING of grain in a bin using free energy of atmospheric air. Optimum utilization of energy in the operation of ventilation fans and dehumidification of atmospheric air without waste of energy is achieved by operating fans and infrared emitters only when required as dictated by the measured temperature differential between the air entering and the air exhausting from the bin. As physiological activity and metabolic processes of the freshly harvested seeds decrease, as indicated by exchanges of heat and moisture between the seeds and the environment, the energy needed to maintain a biologically safe environment also decreases. Energy is considered to be wasted when it forcibly causes the seed to release moisture at a rate more rapid than would occur under average atmospheric conditions; further, required levels of ventilation and levels of dehumidification are variable according to levels of heat-loss obtained during ventilation and according to actual moisture content of the grain. An understanding of the interaction between grain and the atmosphere allows for optimum use of atmospheric resources, namely, sun, wind, and humidity of air, while minimizing energy inputs in their supplementation during the process of curing.

16 Claims, 2 Drawing Figures

METHOD FOR CONTROLLING THE CURING OF FIELD-HARVESTED GRAINS WITH MINIMUM ENERGY CONSUMPTION

BACKGROUND OF THE INVENTION

The present invention relates generally to the curing of grain in an essentially closed environment and more particularly to a process for minimizing the consumption of energy during the process of curing, while at the same time maintaining maximum quality in grain. Typically, this is accomplished in a round steel bin with a perforated floor and fan means to force air through the stored grain, and dehumidification means to improve air dryness when adverse weather prevails; also having an escape means for exhausting air to the outside. Air movement in grain may be upward or downward to optimize daytime/nighttime conditions.

The practice of field-harvesting grain in an uncured condition greatly increases the risk of deterioration and spoilage. On the surface, it would seem that the high moisture content of the grain is the cause of spoilage. For this reason, equipment has been designed to rapidly extract moisture from the grain using heated air, thereby removing the suspected cause of spoilage. Such equipment has proliferated in various combinations and designs, and is now in widespread usage, with the result that many farmers consume three times more energy in drying corn (at the same time destroying its weight and nutrient value) than they do in producing it.

But the premise upon which the design and production of heated-air drying equipment is based, namely, that moisture in field-harvested grain spoils grain, is false. The application of heat in the forcible removal of water from grain not only represents very large expenditures of monies for equipment, but also represents large expenditures for energy; and in terms of waste, losses resulting from damage to grain is even more costly than the waste of energy.

The fact that a grain kernel is a living seed has all but been overlooked. The economic importance of preserving the living integrity of the seed has been overlooked, and therefore no consideration has been given to the biological limitations of the organism, much less any consideration about regulating its physiological processes which, as a matter of fact, are important not only in optimizing value but also in controlling preservation.

"Drying" and "Curing" are distinct processes. As defined in the Agricultural Engineering YEARBOOK 1977, page 439, "CURING: A form of conditioning as opposed to simple drying in which a chemical change occurs, such as in tobacco, sweet potatoes, etc., to prepare the crop for storage or use." "DRYING: The removal of moisture from a product, usually to some predetermined moisture content." Until now the state of the art has had to do with "drying" of grain, i.e., mere moisture removal, using arbitrary levels of heat and air, but with little or no regard to internal, biochemical changes in the seed. The instant art deals with "curing" in which specific requirements of air quantities and air qualities are made for specific beneficial effects on the live seed.

In that spoilage is generally associated with moisture levels in the seed, and that it must be brought to a "safe level" if above a certain fixed, arbitrary percentage, e.g. 13%, an awareness of a need for "drying" prevails. Also an awareness for the need of rapid harvest prevails and, for drying, therefore, to be practical, it must not inhibit harvest. The conclusion is, therefore, that "fast" harvest requires "fast" drying, and that fast drying is possible only with the use of much air and much heat. Such is the rationale which accounts for the wasteful state of the art that prevails today.

Experience has proven that field-harvesting equipment has far greater capacity than so-called "fast" dryers, consequently, "fast" dryers have become the bottleneck to harvest capacity. However, with storage properly fitted with ventilation equipment, it is possible to harvest the complete crop in a matter of days and to commit the grain to storage, which is capable of stabilizing the grain and of controlling the grain environment by removing moisture and heat as released from the seed, thereby safely extending the time of drying without frustrating harvest speed and without harming the grain.

In U.S. Patent application Ser. No. 422,760, now abandoned, "non" heating of the grain is taught, i.e., chilling stored grain to the wet-bulb temperature by using the free BTU of atmospheric air. This is accomplished by controlled ventilation which evaporates moisture from the grain/air. It is accomplished by using controlled levels of heat input and air volumes in relation to grain moisture and grain volume. In trying to convey an understanding of this new technology, the problem arises that people are so conditioned to accept "heating" of air as a pre-condition to successful drying of grain that they relate to the instant art only in light of preconceived understandings which are based on heated-air drying, and in so doing this teaching is hardly comprehensible to them. A general attitude prevails which lacks an appreciation of the value of preserving "seedlife" and "dormancy".

Since "curing" of grain and the teaching of Steffen is based on understanding seed biology and the natural accomodation that exists between the seed and its environment, the instant art is understandable only with knowledge of interacting physical and biological phenomena. Some of these are:

1. Maximum preservation of food-seeds is obtained by bringing seeds to dormancy under controlled environmental conditions from moment-of-harvest. This is applicable to all food-seeds.

2. Removal of heat from grain is more critical than moisture, in that cooling stabilizes seed chemistry; and temperature is a factor not controlled by the seed.

3. Moisture in the seed is an essential seed ingredient regulated by the seed itself.

4. The elimination of water from the seed is a physiological/chemical process, less effected by atmospheric humidity than by atmospheric temperature under certain conditions.

5. Ventilation requirements are as much a function of seed-temperature as of seed-moisture.

6. Grain is in a "cured" state when its temperature and moisture are in equilibrium with mean, atmospheric temperatures and humidities.

7. Optimum moisture in grain cannot be stated without consideration to grain temperatures.

8. Given adequate ventilation, the temperature and humidity fluctuations which occur daily and seasonally, effectively insure "whole bin" drying and an even equilibrium moisture throughout the bin of stored grain.

9. Atmospheric, daily air conditions require no dehumidification of the air so long as the humidity is at the atmospheric average or below, for the given month.

10. The need for supplemental dehumidification of air is best indicated by evaporative cooling (wet-bulb depression) as occurs within the grain.

11. Lowering of seed moisture and lowering of seed temperature each reflect a stabilizing effect on the grain, and that release of moisture from it is at a slower rate with the lowering of either.

12. That a "dormancy index" for preserving maximum grain stability under atmospheric conditions can be identified as an equilibrium condition of temperature and moisture and is specific for each grain type.

Thus, it can be appreciated that the environmental needs to preserve grain can be defined only if the biological needs are understood. And because no one before Steffen has defined the biological needs, indeed, hardly even recognized the existence of such needs, all kinds of procedures and products have been applied to grain with no real logic. And grain has been the loser, as has been everyone. The losses associated with hot air drying are in terms of (1.) greater expenditures of energy, and (2.) destruction of grain value. In contrast, the benefits experienced in "unheat" curing of grain are that energy consumption is only fractional that of heat methods, and grain shrink is less than ½ that of heat methods. Further, because the integrity of the cell systems of the living seed is preserved, No. 1 corn results. Thus, the end product of "unheat" curing is grain whose value has not yet been realized, because heretofore management methods have not preserved such a level of quality. Because of insensitive procedures, genetic value in grain is destroyed, e.g., high lysine content, waxy maise, etc. Because management methods fragment and desiccate seed ingredients, dust accummulations have become a new explosive hazard; however, this method accomplishes preservation of kernel integrity, which virtually eliminates the grain dust hazard.

From the teaching of Steffen in U.S. Pat. No. 3,408,747, it is made clear that specific levels of airflow are required to remove the moisture from the grain environment as it is released by the seed to the surrounding air. It must be understood that the moisture within the seed is not what causes it to spoil, but moisture in the grain air. On the contrary, seed moisture is a necessary resource that the embryonic organism uses to achieve maturity and biological stability. Forced removal of seed moisture with heat as presently practiced, does injury to the embryo in many ways and permanently alters its vegetative and enzyme system, thus, denying the full potential for recovery of food value from grain.

Because of the gross misuse of air and heat in forcibly removing moisture from grain, gross waste results. By carefully defining air quantity and air quality as they relate to seed biology, great savings of energy can result, both as to expenditures required in ventilating grain, and as to energy requirements to maintain the correct dryness in air that is blown through the grain. It is an unrealized fact that it costs the producer less money to preserve seed-perfect corn through curing than it does to produce dead grain through drying without going back to ear corn methods.

In conventional heated-air drying of grain, propane and natural-gas are employed in open-flame burners, so that the products of combustion as well as heat are injected directly into the grain. Not the least of these undesirable products is water itself. For example, the combustion of propane produces more than 1½ times its own weight in water. Thus, with the 1 to 3 million BTU/hr. burners employed, in a 24 hour period of constant heat, from 200 to 600 gallons of water will be generated and injected into the grain air. Hydrocarbons also contaminate the grain. In addition to creating a biologically hostile environment to grain, the production of water contributes to further unnecessary waste of energy in that it must itself be evaporated from the grain air, and its accummulation in interstitial spaces congest the flow of air causing increased pressures and reduction of air flow. To overcome this congestion of air, it is common practice to apply larger horsepower centrifugal fans. These high-pressure fans are far less efficient than low pressure fans, thus, this substitution of fan design itself accounts for greater expenditures of energy. Waste compounds waste. A single 5 HP vaneaxial fan delivers 9,680 cubic feet of air per minute at 2" static pressure; thus, at the same pressure two 5 HP fans would deliver twice the air volume of a single fan, or approximately 19,360 cubic feet. Contrast that with a 20 HP centrifugal fan which delivers only 16,900 Cfm at 2" static pressure.

With low-pressure drying (under 4" S.P.) as occurs in "unheat" curing, vane-axial fans are most efficiently employed. High-heat/high-pressure grain drying inevitably leads to increased expenditures of energy.

SUMMARY OF THE INVENTION

The instant invention teaches a method of curing grain in a closed environment that minimizes energy requirements to operate ventilation fans and air dehumidifying (infrared emitters) means. The fans and infrared emitters are selectively controlled in response to the temperature differentials that occur between the air entering and the air exhausting from a bin of stored grain. Required levels of ventilation and supplemental levels of dehumidification decrease as the temperature differential increases. A large temperature differential indicates that the air has a large moisture removing capacity and that lesser volumes of air are required than with air having lesser capacity. A low temperature differential indicates a low moisture holding capacity of the air, which capacity might be selectively increased by predetermined amounts in response to temperature differentials which obtain. Increase of air volume would have the same effect, i.e., increase moisture-removing-capacity. Also, as grain moisture decreases, its release from the grain is slower, so that lesser volumes of air are needed in ventilation to maintain stable conditions. Reduction of grain moisture calls for reductions of ventilation.

An object of the present invention is the provision of an improved method for curing grain.

Another object is to provide a method for drying grain which utilizes the least energy necessary to safely secure and cure grain to a maximum level of value.

A further object of the invention is the provision of a method for curing grain using multiple fans and multiple infrared emitters which are selectively energized and controlled in response to the temperature differential between the air entering and the air exhausting from the grain storage structure.

Yet another object, is to reduce energy usage by the ventilation and dehumidification means in response to reductions of grain moisture.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
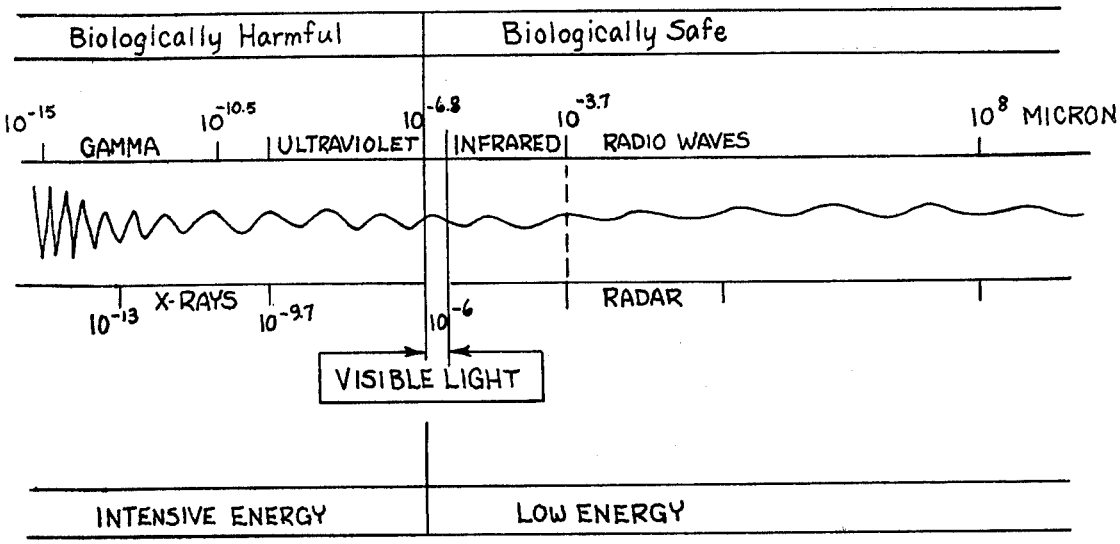
FIG. 1 is a graph showing the electromagnetic spectrum highlighting the infrared range.

This invention relates to maintaining grain in a correct biological environment by maintaining the correct level of ventilation and the correct quality of air without waste of energy at any time. The release of moisture from the seed is regulated more by atmospheric temperature than atmospheric humidity. The significance of this fact is that the release of moisture from the seed is at a more rapid rate, given warmer temperatures than it is at cooler temperatures. When water is released at a more rapid rate, a higher level of ventilation is required to remove it. Therefore, given a certain moisture level in the grain, if the grain temperature can be lowered, a lower volume of air is required, and therefore, a lower level of energy-use to accomplish this ventilation. In light of this teaching, it is understandable why it is economically important to be able to control the ventilation rate, namely, because it conserves energy and preserves valuable food-grain. In fact, as a basic principle, it can be stated: greater energy in grain is preserved when least energy is applied and when maximum heat is removed. The common practice today is simply to apply a high level of ventilation with a single fan, without any consideration to alterning the ventilation rate as conditions within the grain warrant.

Further, since the object of this process is to hold grain temperature to the lowest possible level, given atmospheric conditions, it can be seen why, under certain situations, e.g., immediately following harvest, it may be desirable to minimize or eliminate daytime operation of ventilation means in favor of nighttime for the purpose of obtaining maximum coolness in grain, thereby decreasing ventilation requirements and energy expenditures for ventilation.

In U.S. Pat. application Ser. No. 422,760, now abandoned, Steffen teaches the constant monitoring of heat-loss in the drying air from the time it enters the grain to the time it exhausts; he teaches that a measure of expenditure of heat in the evaporation of moisture is a direct indication of grain "drypoint" and is, therefore, the correct indicator to be used in controlling the proper input of heat (typically with electrical heat lamps) so as to control the capacity of the air for holding moisture without bringing grain temperatures above atmospheric temperatures and without excessive removal of moisture.

The teaching of the instant patent is that heat-loss (from evaporative cooling) slows down the release of moisture from the seed, and that, depending upon the level of cooling achieved, a certain level of airflow is required, and that selective regulation of airflow can be made also in response to the level of cooling that occurs. Thus, by using multiple fans on a given installation, the operation of these fans can be regulated according to the air required to purge the moisture from the grain air. For example: using a horsepower ratio of 1 HP per 1,000 bushels of corn, an airflow of 3 Cfm/bu. can be attained in grain depths up to 11–12'; at 25% moisture, grain requires a ventilation rate of 3 Cfm/bu. If the ventilation system consists of 10 individual 1 HP fans, the correct horsepower ratio would apply for 10,000 bushels of grain. Were the bin to be filled to the 12' depth, all 10 of the fans would need to be put in operation. However, once the grain temperature is brought to the wet-bulb temperature, a lesser volume of air may be required depending on what the actual wet-bulb temperature would be. Thus, fan operation could be controlled according to observed wet-bulb temperature in this way: so long as the wet-bulb temperature-drop is no more than 8° F. from the dry-bulb, all fans continue operating; if the wet-bulb temperature is 8° to 20° F. colder than the dry-bulb, 3 fans would be deactivated; if the wet-bulb temperature is more than 20° F. lower than the dry-bulb, 3 more fans would be deactivated so that a total of 4 fans would continue in operation. A very large differential of temperature between dry-bulb (plenum-atmospheric) and wet-bulb (exhaust) indicates a very great capacity for holding moisture, and because of this greater capacity, a given amount of water will be removed with a lesser volume of air than might be removed with larger volumes of air having lower water-carrying capacities; also, it must be kept in mind that the greater the cooling, the more slowly is water released from the seed.

In order to understand the energy saving potential that results from evaporative cooling, the effect of heat in reducing the efficiency of air movement and increasing energy expenditure must be understood as explained before.

Typically, fans are rated to deliver a certain volume of air at a given pressure; when the pressure increases, the air volume decreases. For example, a typical 5 HP (Chicago), vane-axial grain fan delivers 11,300 Cfm of free air; whereas, at 2" static pressure it delivers 9,580 Cfm and at 4" static pressure it delivers only 7,120 Cfm. Thus, it is seen that a given fan will provide greater ventilation to grain at lower pressures than it can at higher pressures; it is, therefore, desirable to keep pressure at as low a level as possible to obtain maximum air for the energy expended.

Air pressure is affected by air temperature. An increase of temperature causes air to expand, and as it expands it exerts greater pressure. For example, one pound of dry air at 40° F. occupies 12.59 cubic feet; raising the temperature of air to 140° F. will expand its volume to occupy 15.12 cubic feet. It is common for air temperatures to be from 140° to 200° F. in heated-air drying grain. Thus, a greater air pressures are created as a result of heat being added; in order to obtain sufficient levels of airflow under such situations, the typical reaction is to increase horsepower, thereby increasing expenditure of energy.

In contrast to this situation, "unheat" curing, i.e., chilling of grain-air with evaporative cooling, has the effect of reducing air pressure; the greater the wet-bulb depression (temperature drop) the lower the air pressure, and less horsepower is required to obtain adequate ventilation. As the temperature and pressure in the grain drops, the flow of air becomes more free. In light of this knowledge, it is apparent that if temperature-drop can be used as a guide to decreasing horsepower requirements, so can pressure-drop, in that temperature and pressure inter-relate and that pressure-drop also means freer movement of air. Thus, lowering the horsepower may be applicable. Reference to Philippine Patent application Ser. No. 15,485 by Steffen is made as to his teaching of this aspect. Thus, a series of airflow (pressure) indicators and/or switches can be located in the grain column to respond to pressures (airflow) at these points so as to allow deactivation of fans when decreases of pressure (increased airflow) occur at these monitoring locations.

While it is true that nature, on-the-average, provides all the BTU required (solar radiation) to dry and cure grain safely, it is also true that there are times when weather conditions are adverse and some dehumidification of air is required to maintain adequate evaporation for a safe grain environment.

With respect to efficient energy utilization, the type of dehumidification employed is very much at issue. For example, simple electrical, resistance heaters in a fan stream are not only a heavy drain on the electrical circuit but can aggravate deterioration in the grain by raising grain temperatures and causing an acceleration of bio-activity in the grain.

In U.S. Patent application Ser. No. 422,760, now abandoned, Steffen teaches the use of heat lamps that are conventionally available. Such lamps typically provide energy in both the infrared and visible light spectrum. Infrared energy has specific, non-obvious efficiencies with respect to dehumidification because it acts directly upon the water molecule. The transfer of infrared energy to the water molecule is not by conduction or convection, but by harmonics which increases the specific free energy of the water molecule. Because of their higher level of free energy, energized molecules of water do not condense but act as "drying" agents when in contact with less energized water molecules, i.e., their energy transfers to the less energized molecule. Radiant energy (non-visible) traveling in the infrared wavelength energizes the water molecule and puts it in an active state which causes free water to disperse and vaporize and causes vapor molecules to disassociate so that the moisture moves out with the airstream. Energized water molecules might be termed "dry water". When air with "dry water" is introduced into grain/air, for example, the moisture therein is acted upon and carried out. Thus, in the truest sense, infrared puts heat on the water, but not on the grain.

To obtain maximum efficiency in the use of electrical energy it is desirable to convert it to a form which is selective and effective in acting upon water without adversely effecting seed biology and the grain environment. In order to appreciate biologically safe energy forms and how they obtain in nature it is necessary to have some understanding of the electromagnetic spectrum and how radiant (solar) energy flows in varying wavelengths.

Growth and maintenance of life on earth depend on infrared radiation, for many reasons yet undiscovered. Infrared can have certain inhibiting effects on microorganisms, specifically, freemoving spores are desiccated and rendered dormant with exposure; and even with sufficient exposure to specific wavelengths are in instances rendered totally inactive. As herein taught, the application of infrared in a grain bin plenum, is of sanitizing value because of inactivation of airborne spores. Heated-air drying, on the contrary, creates a warm, moist environment which encourages mold and bacterial action, and infestation of grain.

To understand "harmonic energy" of infrared it is necessary to understand the harmonic nature of matter. A molecule is a world of its own. It has a "Sun" (nucleus) in its center and "Planets" (electons) circling around it. Some molecules are small and simple with a few "planets"; others are larger and much more complex. And from these little "worlds" energy pulsates. Vibrates. Radiates. Each kind of molecule has its own specific rate of energy emission. The specific emission can be compatible, and thus responsive to specific wavelengths of radiant, solar energy in the atmosphere. Such energy transfer is called "harmonics".

Some molecules will respond to a certain "harmonic" radiation of solar energy, whereas, others may not. "Harmonics" are of different intensities, that is, of more concentrated or less concentrated energy. In different "wavelengths". Some harmonics are destructive because they are energy-intensive. To illustrate the transfer of harmonic energy: the sound vibration of a specific musical note can shatter a crystal glass, whereas, infrared energy from the sun makes a seed grow. Though unseen and unfelt, powerful, harmonic forces are constantly at work in nature, but in very specific ways.

Life systems on earth depend on "harmonic" energy radiating from the sun. The sun's energy travels in waves of different harmonics, high intensity, low intensity, and inbetween intensities. The specific band of energy waves coming from the sun that are compatible with living systems, and which energize their "harmonics" are infrared radiation.

Over 50% of the energy given-off by the sun is infrared energy. The range of energy waves forming from the sun is called the "electromagnetic Spectrum".

Water is the single most important attenuator (catcher) of infrared energy because the "harmonics" of energy in the specific wavelength of infrared is most compatible to the "harmonics" of molecular motion in $H_2O$, and therefore the water molecule is quick to respond to it. Carbon dioxide, being a triatomic molecule has similar attenuating abilities like water.

It is incorrect to state that infrared "heats" in the sense of convection or conduction. Water molecules can be energized without raising the temperature of air, which is to say, drying action can be improved without heating.

Infrared is nature's energy of dehumidification, that is, infrared energy is a form of energy that water is most responsive to. Therefore, when electrical energy is convertd to infrared energy, it is perhaps the most efficient possible way of using electrical energy to dehumidify air. Because drying of grain will more and more become an electrical process, knowledge of correct uses of electrical energy are important to prevent waste and reduce cost.

FIG. 1 is a schematic of the electromagnetic spectrum showing the band of wavelengths and their biological relationship.

Infrared wavelengths and visible light wavelengths are seen to be close togehter on the spectrum; infrared is of a broader wavelength and thus a less intense energy form. Visible light emission consumes greater energy and represents greater concentration of energy, and thus less efficient in dehumidification than true infrared. The process preferred as described herein calls for use of true infrared emitters that maintain a conversion of electrical energy to highly efficient levels of infrared, e.g., 1.8 micron, with virtually no emission of visible light. By eliminating visible light emission, not only is more efficient use of electrical energy obtained, but safer use is obtained. Infrared emitters limit concentration of heat and temperature build-up. Typically, infrared emitters may heat their glass enclosure to only 20 percent of the fusable temperature (400° F.) of glass, whereas, light bulb globes may reach temperatures up to 80–90 percent of the fusable temperature of glass. Thus, visible light emitters represent a greater fire hazard than true infrared.

Since the mean, wet-bulb depression that prevails by the month is an indicator of naturally available BTU for the evaporation of free moisture, and since average conditions of nature are entirely adequate to maintain safe drying and biological preservation of grain, the mean, wet-bulb depression serves as the appropriate indicator of the required level of dehumidification under high-humidity, atmospheric air conditions. The sun is the source of this energy. The mean, wet-bulb depression in mid-America during the season of grain ripening (September through December) is approximately 4° F. Thus, a level of dehumidification that accomplishes a 4° F. wet-bulb depression represents the highest level of dehumidification required. Generally, energy expended to effect a 1° F. temperature drop from evaporative cooling is approximately equivalent to the amount of energy required to obtain a 1° F. temperature rise, on the basis of convection/conduction heat. However, a lesser energy input with infrared may be expected to accomplish the same evaporative cooling effect because of its specific action on the water molecule. The mean, wet-bulb depression will be greater than the plotted mean depression in approximately 50% of the years. (Source: 1976 Agr. Engrs. Yearbook. Pp. 407–410.)

Nature on-the-average provides all the necessary BTU to dry grain, but when conditions are below average, some supplemental dehumidification can be required. Thus, it is understandable that there are times when ventilation with atmospheric air alone is adequate, and at other times when correction of humidity is called for, but not to reduce air humidity below the seasonal average. The optimum level of dryness in grain is herein defined as the equilibrium condition obtained in nature, that is, bringing the seed temperature and moisture to equilibrium with average atmospheric temperature and humidity. This DRYPOINT(R) condition of grain is defined as the "dormancy index" of grain which is described in U.S. Patent application Ser. No. 704,996, now U.S. Pat. No. 4,045,878.

With respect to air volumes defined by Steffen to be biologically safe, i.e., 5 Cfm/bushel at 30 percent grain moisture, 1 Cfm/bushel at 20 percent grain moisture, it will be understood that specified levels of energy input are called for to accomplish specific levels of dehumidification as previously described. In U.S. Patent application Ser. No. 422,760, Steffen teaches the activation and deactivation of heat lamp based on heat-loss in the exhaust air. All lamps are either "on" or "off" according to the heat-loss tolerance permitted by thermostats in the plenum and exhaust air, or by other differential temperature controlling means.

It is the teaching of this patent that the amount of dehumidification required may vary with the amount of evaporative cooling sensed, and includes the description of an embodiment that allows for varying levels of dehumidification depending upon the level of evaporative cooling obtained.

Figure 2:
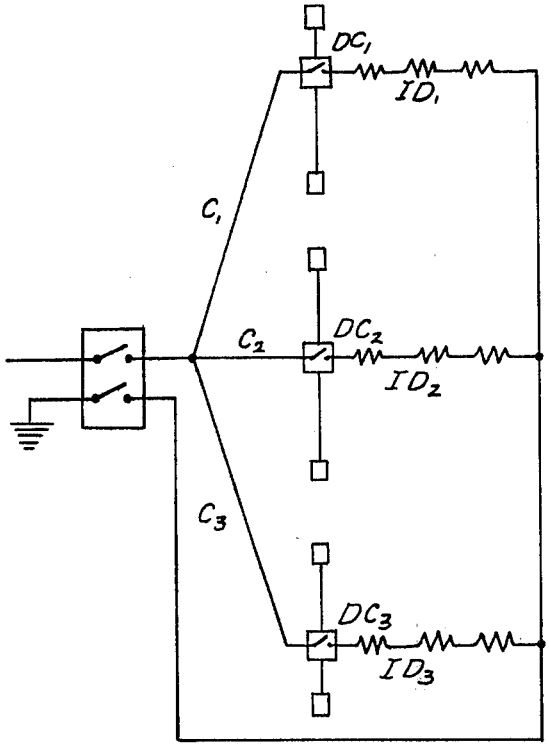
FIG. 2 is a schematic diagram representing a series of infrared emitters controlled by the temperature differential detected by the temperature sensors in the intake and exhaust portions of the grain bin.

FIG. 2 shows a schematic diagram representing a series of infrared dehumidifiers, ID, $ID_2$, and $ID_3$, equally spaced about the plenum. The dehumidifiers are separated by three different electrical circuits, $C_1$, $C_2$, and $C_3$, each of which circuit is activated or deactivated by its own differential temperature controller, $DC_1$, $DC_2$, and $DC_3$, which is selectively adjustable. Such a controller might be like that described in Ser. No. 615,422, now abandoned by Steffen. For example, Controller $DC_1$ may be set to activate Circuit $C_1$ if less than an 8° F. Differential obtains, Controller $DC_2$ activates Circuit $C_2$ if less than a 4° F. differential obtains and Controller $DC_3$ activates Circuit $C_3$ if less than a 3° F. differential obtains. It is readily understood that these settings would vary according to the grain being dried. That is to say, that the equilibrium moisture of different grains vary at a given wet-bulb temperature, so that greater or lesser dehumidification is required with different grains. Typically, the following relationships (Hygroscopic Relationship of Grains) obtain with respect to equilibrium moistures of different grains, so that calibration for optimum differentials can be made accordingly. At moistures shown, grain would be considered dormant. An adjustable dial may be provided on a differential temperature controller which would indicate equilibrium or "dormancy" moisture, so that the dial itself might be called a "dormancy dial" since it would identify the dormancy-moisture-level for the grain being dried, or the "dormancy index".

TABLE 1

HYGROSCOPIC RELATIONSHIP OF GRAINS

Approximate Equilibrium Moisture With An 8° F. Temperature Drop

| GRAIN | MOISTURE | DRY-BULB | WET-BULB | REL. HUM. | DIFF. SETTING* |
|---|---|---|---|---|---|
| FLAXSEED | 8.2 | 70° F. | 62° F. | 60% | 4 |
| SOYBEANS | 9.1 | 70° F. | 62° F. | 60% | 4 |
| ROUGH RICE | 11.1 | 70° F. | 62° F. | 60% | 5 |
| OATS | 11.2 | 70° F. | 62° F. | 60% | 5 |
| POPCORN | 11.5 | 70° F. | 62° F. | 60% | 6 |
| BARLEY | 11.7 | 70° F. | 62° F. | 60% | 6 |
| WHEAT (durum) | 11.7 | 70° F. | 62° F. | 60% | 6 |
| RICE (Undermilled) | 11.8 | 70° F. | 62° F. | 60% | 7 |
| CORN (White dent) | 11.9 | 70° F. | 62° F. | 60% | 7 |
| MILO (Sorghum) | 11.9 | 70° F. | 62° F. 60% | 7 | |
| WHEAT (White) | 11.9 | 70° F. | 62° F. | 60% | 7 |
| WHEAT (Soft, red Winter) | 11.9 | 70° F. | 62° F. | 60% | 7 |
| WHEAT (Hard, red Spring) | 11.9 | 70° F. | 62° F. | 60% | 7 |
| CORN (yellow Dent) | 12.0 | 70° F. | 62° F. | 60% | 8 |
| WHEAT (Hard, red Winter) | 12.1 | 70° F. | 62° F. | 60% | 8 |
| BUCKWHEAT | 12.2 | 70° F. | 62° F. | 60% | 9 |
| RYE | 12.3 | 70° F. | 62° F. | 60% | 9 |
| RICE (polished) | 12.5 | 70° F. | 62° F. | 60% | 10 |

*If temperature drop is greater than the setting, no additional dehumidification of drying air is required.

Obviously, many modifications and variations of the present invention are possible in light of the above teaching. It is therefore to be understood that, within the scope of the appended Claims, the invention may be practiced otherwise than as specifically described without parting from its teaching.

I claim:

1. A process for curing grain in a closed environment having means for removing moisture from the grain including means for forcibly introducing atmospheric air into the closed environment and means for dehumidifying said atmospheric air entering the closed environment, said process comprising the steps of:

placing uncured grain in the closed environment;

adding atmospheric air at one point of the closed environment, allowing the air to pass through the grain, and allowing the air to exhaust at another point in the closed environment;

maintaining the addition of atmospheric air at a first specified rate;

measuring the temperature of the atmospheric air at the point of entry, upstream of the dehumidifying means, and at the point of exhaust from the closed environment;

determining the temperature differential between the incoming air and exhaust air which is, at least in part, a function of the moisture content of a grain; and progressively increasing or decreasing the output of the moisture-removal-means in response to progressively increased or decreased decreased output of moisture by the grain as determined by the sensed temperature differential.

2. The process of claim 1 wherein the step of decreasing the output of the moisture-removal-means includes:

progressively decreasing the output of moisture-removal-means in response to on-going decreases of grain moisture content.

3. The process of claim 1 wherein the steps of increasing or decreasing the output of the moisture-removal-means includes:

progressively increasing the output of the moisture-removal-means in response to progressively decreased temperature differentials;

progressively decreasing the output of the moisture-removal-means in response to progressively increased temperature differentials.

4. The process of claim 3 wherein the step of increasing the output of the moisture-removal-means includes:

progressively increasing the output of the air supply means to specified higher rates of air flow in response to specified decreases of temperature differential.

5. The process of claim 3 wherein the step of increasing the output of the moisture-removal-means includes:

progressively increasing the output of the hehumidifying means to specified higher levels in response to specified decreases of temperature differential.

6. The process of claim 5 wherein the step of increasing the output of moisture-removal-means includes:

use of infrared energy in the specific wavelength of maximum attenuation by the water molecule.

7. The process of claim 3 wherein the step of increasing the output of the moisture-removal-means includes:

progressively increasing the output of the air supply means to specified higher rates of air flow in response to specified decreases of temperature differential; and progressively increasing the output of the dehumidifying means to specified higher levels in response to specified decreases of temperature differential.

8. The process of claim 7 wherein the step of increasing the output of the moisture-removal-means includes:

use of infrared energy in the specific wavelength of maximum attenuation by the water molecule.

9. The process of claim 4 wherein the step of increasing the output of the air supply means includes:

progressively increasing the output of the air supply means to specified higher incrementally discrete rates of air flow in response to specified lower incrementally discrete ranges of the determined temperature differential.

10. The process of claim 5 wherein the step of increasing the output of the dehumidifying means includes:

progressively increasing the output of the dehumidifying means to specified higher incrementally discrete levels in response to specified lower incrementally discrete ranges of the determined temperature differential.

11. The process of claim 6 wherein the step of increasing the output of the moisture-removal-means includes:

progressively increasing the output of the air supply means to specified higher incrementally discrete rates of air flow in response to specified lower incrementally discrete ranges of the determined temperature differential; and progressively increasing the output of the dehumidifying means to specified higher incrementally discrete levels in response to specified lower incrementally discrete ranges of the determined temperature differential.

12. The process of claim 7 wherein said first specified rate of air flow is 1 Cfm per bushel of stored grain;

air flow is increased to 2 Cfm per bushel when said temperature differential is less than or equal to 20° F. but greater than 8° F.; and air flow is increased to 3 Cfm per bushel when said temperature differential is less than or equal to 8° F.

13. The process of claim 8 wherein said dehumidification means is deactivated when said temperature differential is greater than 8° F.;

said dehumidification means is operated at one-third total output capacity when said temperature differential is less than or equal to 8° F. but greater than 4° F.;

said dehumidification means is operated at two-thirds total output capacity when said temperature differential is less than or equal to 4° F. but greater than 2° F.; and said dehumidification means is operated at full output capacity when said temperature differential is less than or equal to 2° F.

14. The process of claim 9 wherein said first specified rate of air flow is 1 Cfm per bushel of stored grain;

air flow is increased to 2 Cfm per bushel when said temperature differential is less than or equal to 20° F. but greater than 8° F.;

said dehumidification means is deactivated when said temperature differential is greater than 8° F.;

air flow is increased to 3 Cfm per bushel when said temperature differential is less than or equal to 8° F.;

said dehumidification means is operated at one-third total output capacity when said temperature differential is less than or equal to 8° F. but greater than 4° F.;

said dehumidification means is operated at two-thirds total output capacity when said temperature differential is less than or equal to 4° F. but greater than 2° F.; and said dehumidification means is operated at full output capacity when said temperature differential is less than or equal to 2° F.

15. The process of claim 2 wherein the step of decreasing the output of the moisture-removal-means includes:

progressively decreasing the output of the air supply means to specified lower rates of air flow in response to specified decreases of moisture in the grain.

16. The process of claim 15 wherein the progressive decrease of output by the air supply means includes:

supplying 3 cubic feet of air per minute to grain with 25% moisture;

supplying 2 cubic feet of air per minute to grain with 22% moisture; and supplying 1 cubic foot of air per minute to grain with 20% moisture.

* * * * *